United States Patent [19]

Horner et al.

[11] Patent Number: 4,779,244

[45] Date of Patent: Oct. 18, 1988

[54] ULTRASONIC TRANSDUCER AND ATTENUATING MATERIAL FOR USE THEREIN

[75] Inventors: Michael S. Horner, Davis; Axel F. Brisken, Shingle Springs, both of Calif.

[73] Assignee: General Electric Company, Milwaukee, Wis.

[21] Appl. No.: 490,577

[22] Filed: May 2, 1983

[51] Int. Cl.[4] ..... H04R 17/00

[52] U.S. Cl. ..... 367/140; 367/176; 181/151

[58] Field of Search ..... 367/154, 155, 156, 162, 367/173, 174, 176, 157, 165; 310/326, 327, 334, 336; 181/151, DIG. 1

[56] References Cited

U.S. PATENT DOCUMENTS

| | | | |
|---|---|---|---|
| 2,972,068 | 2/1961 | Howry et al. | 367/162 X |
| 3,515,910 | 6/1970 | Fritz et al. | 367/162 X |
| 3,794,866 | 2/1974 | McElroy et al. | 367/162 X |
| 3,894,169 | 7/1975 | Miller | 367/157 X |
| 3,922,572 | 11/1975 | Cook et al. | 367/157 X |
| 4,528,652 | 7/1985 | Horner et al. | 310/327 X |

OTHER PUBLICATIONS

Beerman, Optimizing Matching Layers for a Three--Section Broad Band Transducer, IEEE, Vo. SV-20, No. 1, Jan. 1981.

*Primary Examiner*—Brian S. Steinberger
*Attorney, Agent, or Firm*—Flehr, Hohbach, Test, Albritton & Herbert

[57] ABSTRACT

An ultrasonic transducer assembly includes noise suppressing backing material for the transducer comprising a composite of a matrix material and particles of an attenuating soft material such as rubber, epoxy, and plastic. The particle size is preferably selected by sieving the particles through a sieve of grid size 30 to 80. In preferred embodiments the particles of attenuating soft material are filled with particles of heavy oxides, metal powders, or other density lowering fillers. The ratio of matrix material to filler particles determines mechanical strength and attenuation of the composite material. Attenuation coefficient and size of the filler particles determines the attenuation of the composite material.

8 Claims, 2 Drawing Sheets

ULTRASONIC TRANSDUCER AND ATTENUATING MATERIAL FOR USE THEREIN

This invention relates generally to ultrasonic transducers, and more particularly the invention relates to improved ultrasonic attenuating material for use in ultrasonic transducers and the like.

Ultrasonic scanning apparatus such as used for medical diagnostic purposes or non-destructive material evaluation utilize sound transducers to transmit ultrasonic waves (e.g. on the order of several megahertz) into a patient or test object and to receive echo signals. The echo signals are converted to electrical signals by the transducer, and the electrical signals are electronically processed and used to control a display apparatus for depicting the internal structure of a patient or the object.

Artifacts in the display due to noise and extraneous signals can degrade the image. Particularly, ultrasonic echoes reflecting from physical members within the transducer housing and reverberations can degrade the diagnostic utilit of the system. Since the pulsed transducer element or elements of an array radiate ultrasonic energy from all surfaces, sonic energy attenuating backing material must be provided about the transducer element or elements to limit wave propagation from and reception by a single "radiative" surface of the transducer. It is especially important that backing materials attenuate ultrasonic energy in dimensions small compared to the geometric structures of the device. It is also important that backing materials have low acoustic impedances when compared to transducer material impedance so as to not reduce transducer overall sensitivity.

Heretofore, backing materials have proved to be deficient. Adhesively bonded or compression molded rubbers such as neoprene and gum rubber limit the design geometry of a transducer assembly by eliminating the ability to encapsulate wire leads, components, and other fragile structures. Filled hard epoxy systems are relatively poor ultrasonic wave attenuators. Commercially available silicone rubber formulations offer only moderate acoustic impedance and ultrasonic wave attenuation.

Co-pending application Ser. No. 335,635, now U.S. Pat. No. 4,528,652 filed Dec. 30, 1981, for "Ultrasonic Transducer and Attenuating Material For Use Therein", assigned to the present assignee, discloses backing material comprising a heavily loaded silicone rubber based on an unfilled low viscosity potting gel with a filler selected from heavy oxides, metal powders, and density lowering fillers such as glass microballoons.

An object of the present invention is an improved ultrasonic transducer assembly.

Another object of the invention is an improved attenuating material for use with ultrasonic transducers and the like.

In accordance with the invention a transducer assembly having improved noise suppression characteristics is provided which includes an ultrasonic transducer means, a housing for receiving the transducer means whereby one surface of the transducer is free to transmit and receive ultrasonic waves, and a backing material positioned about the transducer and between the transducer and the housing for attenuating stray ultrasonic energy. The material comprises a matrix containing particles of highly attenuative soft material. In preferred embodiments, the attenuative material may include particles of rubber, flexible epoxy, or soft plastic. The attenuative soft material is preferably loaded with one or heavy metal oxide particles or metal particles. A low viscosity, hard curing epoxy can be used as the matrix material.

The invention and objects and features thereof will be more readily apparent from the following detailed description and appended claims when taken with the drawing, in which:

Figure 1A:
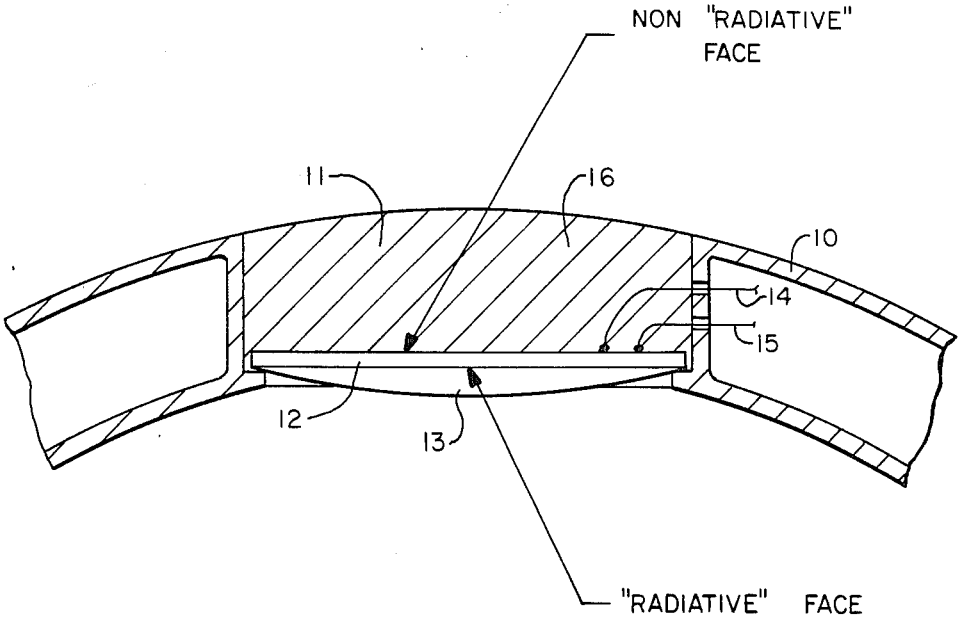
FIGS. 1A and 1B are cross sectional views of a single element transducer and array transducer, respectively, in accordance with the invention.
Figure 1B:
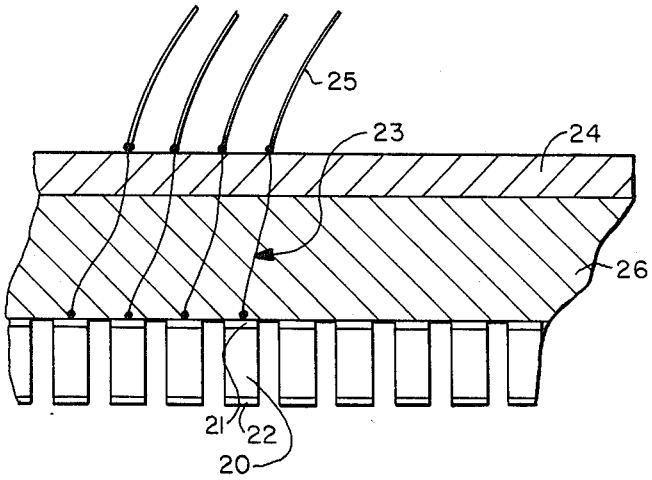

Referring now to the drawings, FIGS. 1A and 1B are cross sectional views of a single element and array transducer, respectively. The single element assembly of FIG. 1A includes a housing 10 having a recessed portion 11 which receives a transducer element 12 and its focusing lens 13. The transducer element may consist of a singular piece of electroacoustically active material or may include acoustic impedance matching layers on the radiative surface. Signal lead 14 and ground lead 15 pass through the housing wall into the recessed portion 11 and are connected to the transducer element 12. The attenuating backfill material 16 is shown as a casting over the back side of the transducer element 12, encapsulating signal 14 and ground 15 lead wires.

The array assembly of FIG. 1B includes a plurality of independent transducer elements 20 with signal electrode 21 and ground electrode 22 on opposite faces. Due to the small physical size of the individual elements 20, the signal lead wire 23 is extremely thin (typically 0.001 inches diameter) and fragile. The wire leads 23 pass up to a structural member 24 for connection to external wiring 25. The attenuating backfill material 26 is poured over the back of the elements 20 and around the thin lead wires 23. Again, the individual transducer elements may consist of singular pieces of electroacoustically active material or may include acoustic impedance matching layers on the radiative side 22.

Figure 2A:
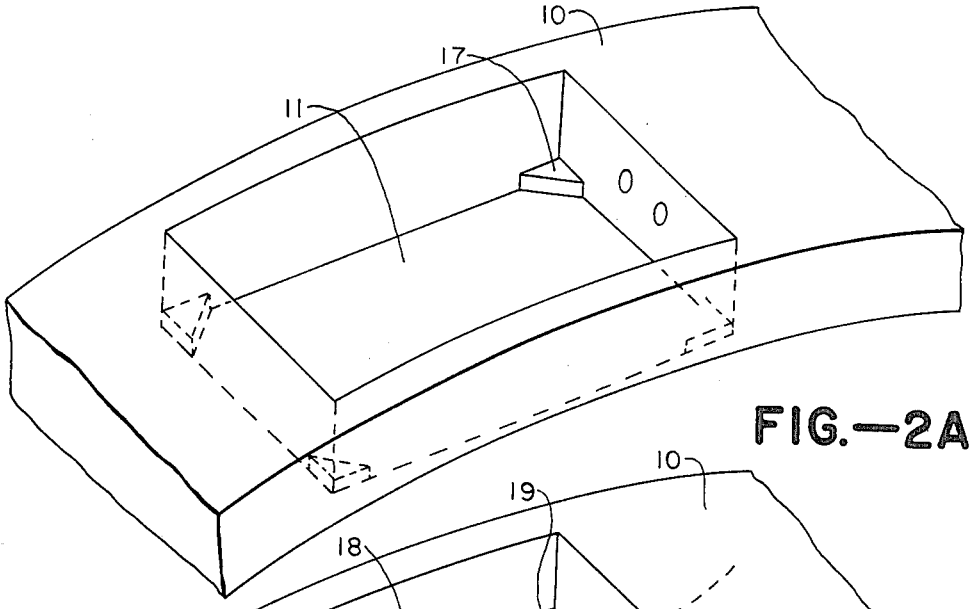
FIGS. 2A–2C are perspective views of the single element transducer assembly of FIG. 1 which illustrate fabrication of the assembly.
Figure 2B:
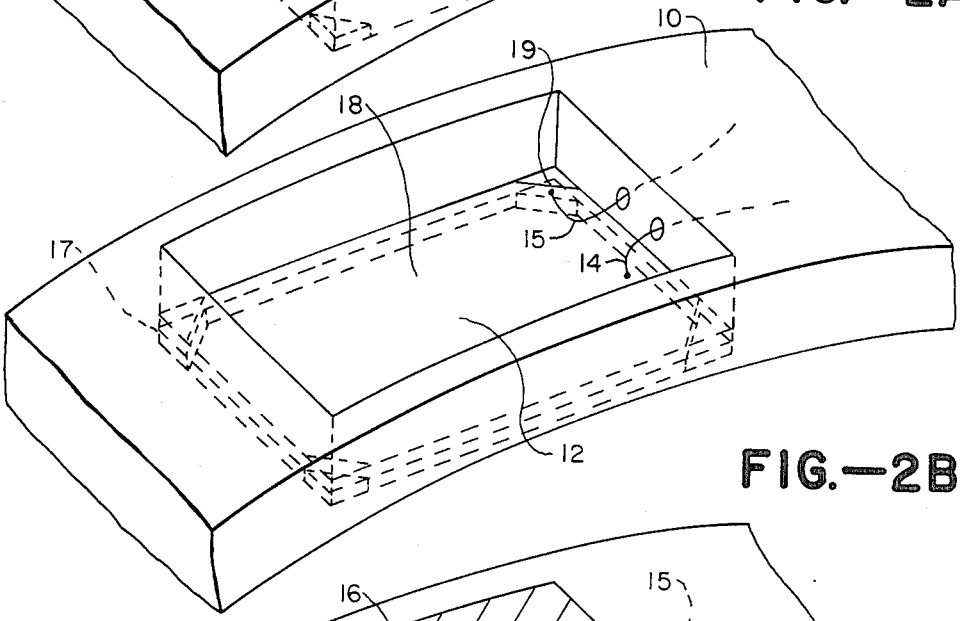
Figure 2C:
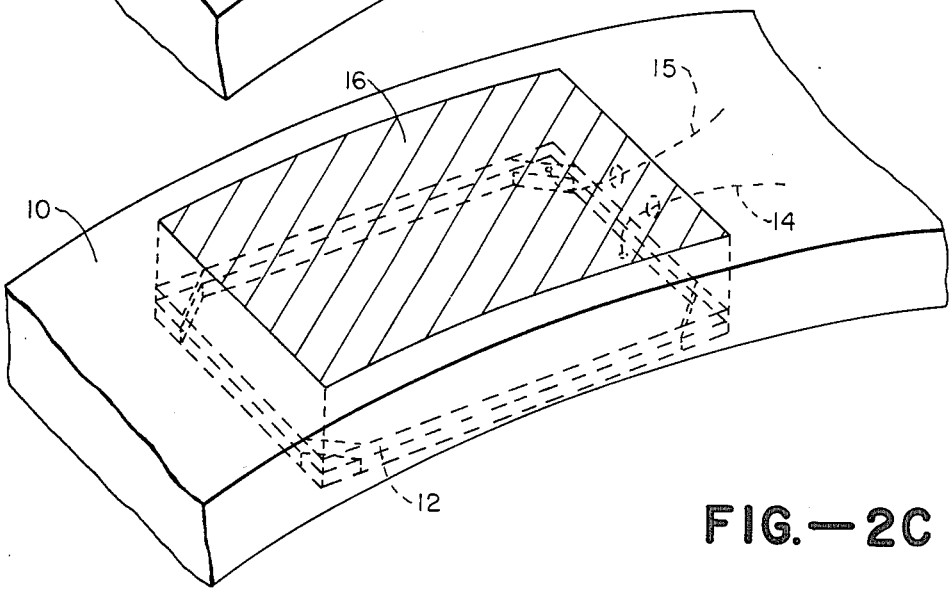

FIGS. 2A, 2B and 2C illustrate the fabrication of the single element transducer assembly. In FIG. 2A, the housing 10 and recessed area 11 are shown prior to the positioning of the and securing of the element 12 in the frame 10, the signal lead 14 and ground lead 15 are attached to the transducer element signal electrode 18 and ground electrode 19, respectively. Lastly, as sketched in FIG. 2C, the attenuating backfill material 16 is cast over the assembled transducer element. Casting the backing material 16 directly onto the transducer element 12 causes them to come into intimate contact.

In an ultrasonic scanning operation the transducer is normally energized to transmit ultrasonic signals having a frequency on the order of a few megahertz, and reflected signals of much smaller amplitude are received by the transducer and converted to electrical signals. As above described, the pulsed transducer elements radiate ultrasonic energy from all surfaces, and low impedance acoustic absorbing material must be provided as backing between the transducer and the environment. Materials having ultrasonic attenuation of 0–7 decibel per megahertz per centimeter (dB/Mhz/cm) are considered poor absorbers, and materials having attenuation of 8–30 dB/Mhz/cm are considered only moderate absorbers. Backing materials having attenuation of 30–60 dB/Mhz/cm are considered good absorbers, and any material having an attenuation greater than 60 dB/Mhz/cm is considered exceptional.

Heretofore backing materials for use in ultrasonic transducers have offered moderately low attenuation. For example, filled hard epoxy systems typically have an attenuation of 5–12 dB/Mhz/cm and are characterized by unacceptably high acoustic impedances. Off-the-shelf silicone rubber formulations have favorably low acoustic impedances of typically $1.0–2.2\times10^6$ rayls but moderately low attenuation of 6–20 dB/Mhz/cm. Known attempts at using silicone rubber with heavy oxide fillers have been only moderately successful. For example, General llectric (GE) RTV-11 silicone has been loaded with lead oxide in a mixture of 1 part silicone to 0.7 parts of lead oxide for use in acoustic structures. This mixture offered an acoustic attenuation of 44 dB/Mhz/cm, but was limited by high viscosity and little versatility in fabrication. Adhesively bonded or compressed molded rubber such as neoprene and gum rubber limit design geometry by eliminating the ability to encapsulate wire leads, components, and other fragile structures.

In accordance with the invention, the backing material comprises a suitable matrix material to which is added particles including a highly attenuating soft material such as rubber, flexible epoxy, soft plastic, and the like. The soft material is preferably ground into a powder by suitable means and sieved to classify the powder by size. The matrix material, preferably a low viscosity, hard curing epoxy, provides mechanical support for the ceramic transducer while the particles of absorbing material act as scattering and absorbing attenuators. In preferred embodiments, the particles of soft material may be filled with particles selected from heavy oxide, metal powders, and the like.

In one embodiment the matrix material comprises Epotek 301 TM manufactured by Epoxy Technology Inc., which is a low viscosity room temperature curing epoxy. One part of resin (by weight) of Eccosil 2CN manufactured by Emerson and Cumings, a low viscosity silicone rubber, was mixed with three parts of lead mono-oxide particles. The mixture was brought to a full cure. The rubber and lead mono-oxide mixture was then ground with a rotary file and sieved through a number 80 (ASTME-11 standard sieve #80) screen. The mixture of particles was mixed one part to one part with the Epotek 301 epoxy matrix material. This embodiment provides 60 dB/Mhz/cm of attenuation.

In another embodiment using the same matrix material, one part low viscosity Eccosil 2CN was mixed with three parts of lead mono-oxide, cured and then grated into flat flakes approximately 1/16 inch to ⅛ inch diameter by 0.020 inch thickness. One part matrix was mixed with 0.8 parts of the rubber/lead oxide filler. The filler settled so that particles were aligned in a flat layer similar in appearance to particle board. This embodiment provides approximately 80 dB/Mhz/cm of attenuation.

In another embodiment using Epotek 301 matrix material one part Eccosil 2CN was mixed with 3.14 parts of tungsten powder (1.0 to 5.0 micron diameter). Again, the silicone rubber/tungsten mixture was allowed to cure and was then ground with a rotary file and sieved through a number 80 screen. One part matrix material was mixed with 1.44 parts of the rubber/tungsten filler. This embodiment provides 80 to 100 dB/Mhz/cm of attenuation.

In each of the embodiments the mixture of epoxy matrix material and filler material is placed in a vacuum for approximately 15 minutes to deair the liquid/filler mix. The backing material is then affixed or cast onto the back surface of the piezoelectric transducer. The composite backing material is allowed to cure at room temperature for 24 hours. The backing material thus becomes a hard rigid frame, housing, spacer, or other structure and an attenuating absorber for ultrasound applications where damping or nontransmission of ultrasound is desirable.

The epoxy matrix provides mechanical strength for the piezoelectric ceramic transducer while the particles of material act as scattering and absorbing attenuators. In the composite attenuative backing material, the mechanical strength can be increased by increasing the ratio of matrix material to filler material. Attenuation can be increased by decreasing the ratio of matrix material to filler material, by increasing particle size, and by increasing the attenuation coefficient of the particle material. Particle size is preferably determined by passing through a sieve of 30–80 grid size (ASTME-11 standard sieve). Random sizes in this range may be chosen. The matrix material may be a curing liquid such as epoxy, acrylic, or other hard system. The matrix may also be a compression molded powder.

There has been described a new and improved ultrasonic transducer assembly and composite attenuative backing material for use therein. While the invention has been described with reference to specific embodiments, the description is illustrative of the invention and is not to be construed as limiting the invention. Various modifications and application may occur to those skilled in the art without departing from the true spirit and scope of the invention as defined by the appended claims.

What is claimed is:

1. An ultrasonic transducer assembly having improved noise suppression characteristics comprising ultrasonic transducer means having a plurality of surfaces, a housing for receiving said transducer means whereby one surface of said transducer means is free to transmit and receive ultrasonic waves, and a composite material positioned about said transducer and between said transducer and said housing for attenuating ultrasonic energy, said composite material comprising a matrix material and particles of an attenuating soft filler material loaded with material from the group consisting of heavy oxides, metal powders, and density lowering fillers, said soft material being selected from the group consisting of rubber, epoxy, and plastic.

2. The ultrasonic transducer assembly as defined by claim 1 wherein said particles are selected by sieving said particles through a sieve ASTME-11 of grid size selected from 30 to 80.

3. The ultrasonic transducer assembly as defined by claim 1 wherein said matrix material is a curing liquid selected from the group consisting of epoxy and acrylic.

4. Material for providing ultrasonic wave attenuation in a transducer assembly and the like comprising a composite of a matrix material and particles of an attenuating soft material loaded with material selected form a group consisting of heavy oxides, metal powders, and density lowering fillers, said soft material selected from the group consisting of rubber, epoxy, and plastic.

5. Material as defined by claim 4 wherein said particles are selected by sieving said particles through a sieve of ASTME grid size selected from 30 to 80.

6. Material as defined by claim 4 wherein said particles are selected at random size and shape by sieving said particles through sieves of ASTME-11 grid sizes ranging from 30 to 80.

7. Material as defined by claim 4 wherein said particles are filled with particles selected from a group consisting of heavy oxides, metal powders, and density lowering fillers.

8. Material as defined by claim 4 wherein said matrix material is a curing liquid selected from the group consisting of epoxy and acrylic.

* * * * *